US006148637A

United States Patent [19]

Guillard et al.

[11] Patent Number: 6,148,637

[45] Date of Patent: Nov. 21, 2000

[54] AIR-DISTILLATION PLANT AND CORRESPONDING COLD BOX

[75] Inventors: Alain Guillard, Paris; Patrick Le Bot, Vincennes; Jean-Marc Tsevery, Lieusaint; Gilles Bracque, Saint Leu d'Esserent; Benoit Rousseau, Fontenay-Aux-Roses, all of France

[73] Assignee: L'Air Liquide, Societe Anonyme pour l'Etude et l'Exploitation des Procedes Georges Claude, Paris Cedex, France

[21] Appl. No.: 09/245,875

[22] Filed: Feb. 8, 1999

[30] Foreign Application Priority Data

Feb. 6, 1998 [FR] France ..... 98 01434

[51] Int. Cl.[7] ..... F25J 3/00

[52] U.S. Cl. ..... 62/643; 62/905

[58] Field of Search ..... 62/643, 905

[56] References Cited

U.S. PATENT DOCUMENTS

| | | | |
|---|---|---|---|
| 4,006,001 | 2/1977 | Schonpflug . | |
| 4,957,523 | 9/1990 | Zarate et al. . | |
| 5,408,831 | 4/1995 | Guillard et al. . | |
| 5,412,954 | 5/1995 | Grenier | 62/905 |
| 5,461,871 | 10/1995 | Bracque et al. | 62/905 |
| 5,617,742 | 4/1997 | Toppel | 62/905 |
| 5,735,141 | 4/1998 | Whitlock | 62/905 |

FOREIGN PATENT DOCUMENTS

| | | |
|---|---|---|
| 5-187764 | 7/1993 | Japan . |
| 687008 | 4/1953 | United Kingdom . |

*Primary Examiner*—Ronald Capossela
*Attorney, Agent, or Firm*—Young & Thompson

[57] ABSTRACT

The plant (1) comprises at least three assemblies (10, 11, 12) arranged one beside the other, namely a first assembly (10) comprising a medium-pressure column (2), a second assembly (11) comprising a low-pressure column (3), and a third assembly (12) comprising a heat-exchange line (5). The plant further comprises a liquid pump (6) for making a liquid flow between one of the columns (3) and the vaporizer-condenser (4). Application to the distilling of air using columns with structured interior packing.

24 Claims, 6 Drawing Sheets

AIR-DISTILLATION PLANT AND CORRESPONDING COLD BOX

Figure 1:
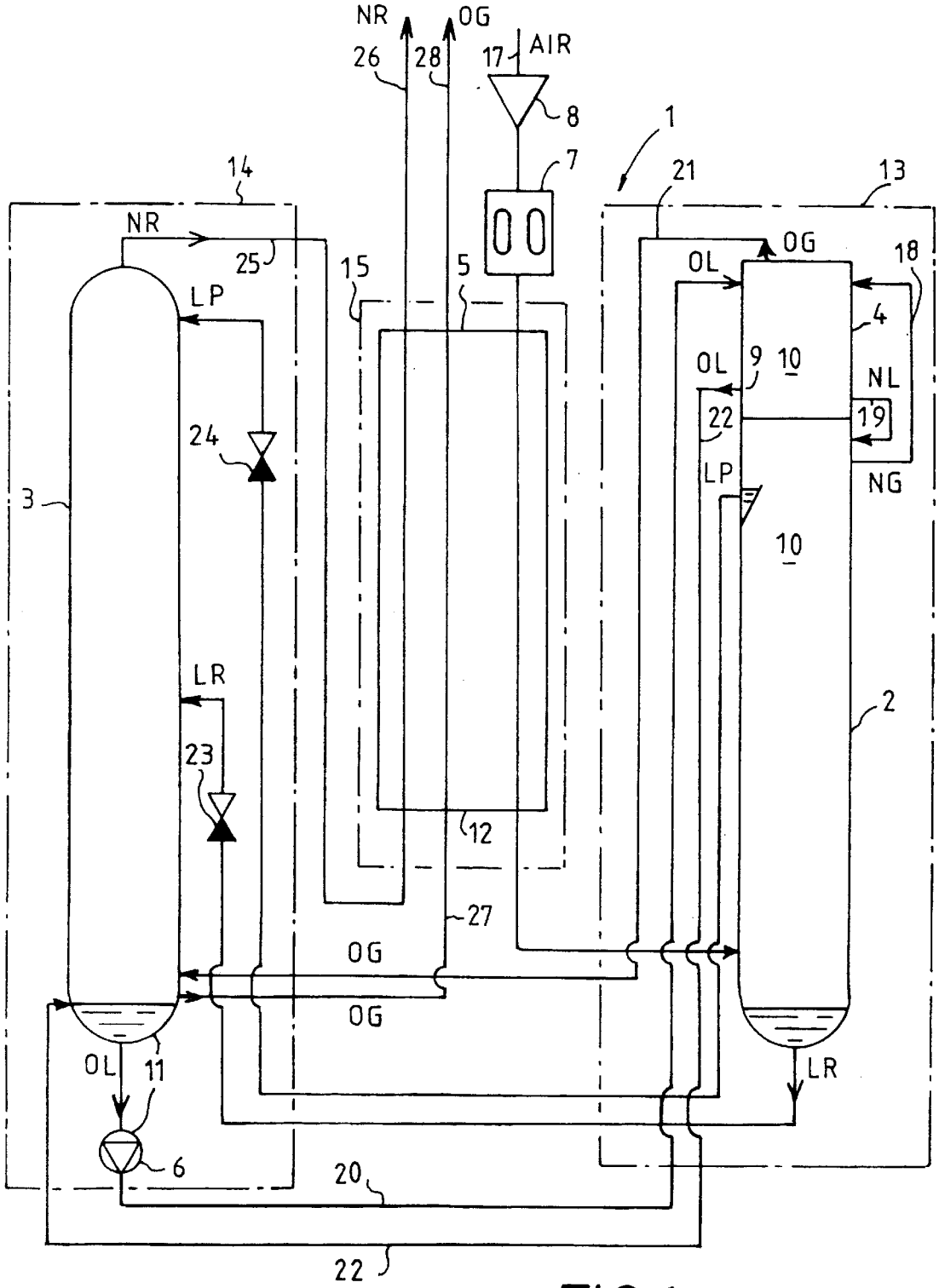

The present invention relates to an air-distillation plant of the type comprising at least one medium-pressure column, one low-pressure column and one vaporizer-condenser, the medium-pressure column being connected to a conduit for bringing in air that is to be distilled, and the vaporizer-condenser placing the fluids from the head of the medium-pressure column and from the base of the low-pressure column in a heat-exchange relationship.

The invention applies in particular to air-distillation plants with distillation columns fitted with structured packing, for example of the "cross-corrugated" kind.

Such structured packing affords an important advantage over conventional distillation plates from the point of view of loss of pressure head, and consequently allows substantial savings to be made in the operation of air-distillation plants.

By contrast, for the same theoretical number of plates, the height of a distillation column with structured packing is markedly greater than that of a plate-type column.

The substantial height of the double distillation columns with structured packing, for example of the order of 60 m, presents numerous problems.

Thus, on the one hand, constructing them as packages that are pre-assembled at the workshop and intended to be transported to the industrial site of the plant may prove difficult or even impossible.

On the other hand, erecting these double columns on site entails the use of heavy lifting gear and the creation of special safety measures to safeguard personnel safety, particularly on account of the heights at which they have to work.

Furthermore, the ability of these erected double columns surrounded by their thermal-insulation walls to withstand the effects of wind and earthquakes requires expensive means to be installed.

Finally, the dimensions of these erected double columns generate problems of non-uniform thermal expansion when exposed to the rays of the sun.

The object of the invention is to solve these problems by, in particular, providing a plant of the aforementioned type, which is less expensive and easier to construct.

To this end, the subject of the invention is an air-distillation plant of the aforementioned type, characterized in that it comprises at least The present invention relates to an air-distillation plant of the type comprising at least one medium-pressure column, one low-pressure column and one vaporizer-condenser, the medium-pressure column being connected to a conduit for bringing in air that is to be distilled, and the vaporizer-condenser placing the fluids from the head of the medium-pressure column and from the base of the low-pressure column in a heat-exchange relationship.

The invention applies in particular to air-distillation plants with distillation columns fitted with structured packing, for example of the "cross-corrugated" kind.

Such structured packing affords an important advantage over conventional distillation plates from the point of view of loss of pressure head, and consequently allows substantial savings to be made in the operation of air-distillation plants.

By contrast, for the same theoretical number of plates, the height of a distillation column with structured packing is markedly greater than that of a plate-type column.

The substantial height of the double distillation columns with structured packing, for example of the order of 60 m, presents numerous problems.

Thus, on the one hand, constructing them as packages that are pre-assembled at the workshop and intended to be transported to the industrial site of the plant may prove difficult or even impossible.

On the other hand, erecting these double columns on site entails the use of heavy lifting gear and the creation of special safety measures to safeguard personnel safety, particularly on account of the heights at which they have to work.

Furthermore, the ability of these erected double columns surrounded by their thermal-insulation walls to withstand the effects of wind and earthquakes requires expensive means to be installed.

Finally, the dimensions of these erected double columns generate problems of non-uniform thermal expansion when exposed to the rays of the sun.

The object of the invention is to solve these problems by, in particular, providing a plant of the aforementioned type, which is less expensive and easier to construct.

To this end, the subject of the invention is an air-distillation plant of the aforementioned type, characterized in that it comprises at least two assemblies arranged one beside the other, namely a first assembly comprising the medium-pressure column, and a second assembly comprising the low-pressure column, and in that the plant comprises at least one liquid-rising means for making a liquid flow between one of the said columns and the vaporizer-condenser.

According to particular embodiments of the invention, the plant may comprise one or more of the following features, taken in isolation or in any technically feasible combination:

- at least one of the said columns is equipped with structured interior packing;
- the medium-pressure and low-pressure columns are each made of a single section;
- the plant comprises a third assembly which comprises a heat-exchange line for cooling the air that is to be distilled, and the said three assemblies are placed one beside the other;
- the vaporizer-condenser is arranged with its lower part at more or less the same level as the upper end of the medium-pressure column, and the liquid-rising means comprises a means of sending liquid oxygen from the base of the low-pressure column towards the vaporizer-condenser;
- the vaporizer-condenser belongs to the said first assembly and lies on top of the medium-pressure column;
- the vaporizer-condenser lies on top of the heat-exchange line;
- the vaporizer-condenser is arranged at more or less the same level as the base of the low-pressure column, and the liquid-rising means comprises a means for sending liquid nitrogen from the vaporizer-condenser towards the head of the medium-pressure column
- the vaporizer-condenser belongs to the said second assembly, and the low-pressure column lies on top of the vaporizer-condenser;
- the vaporizer-condenser is arranged under the heat-exchange line;
- the vaporizer-condenser belongs to the said third assembly, and the third assembly is surrounded by a thermal-insulation wall that is common at least to the vaporizer-condenser and to the heat-exchange line;
- the heat-exchange line and the vaporizer-condenser are surrounded by separate thermal-insulation walls;

the vaporizer-condenser is a vaporizer-condenser of the liquid-oxygen trickling type;

the said third assembly is arranged close to the said second assembly so as to limit the head losses, between the heat-exchange line and the low-pressure column, in the pipes which connect them;

the centres of the said first, second and third assemblies form, when viewed from above, essentially a triangle or an L, or essentially a line;

each of the said assemblies is surrounded by an individual thermal-insulation wall so that each forms an individual cold box;

at least two of the said assemblies are surrounded by a common thermal-insulation wall and the last assembly is surrounded by an individual thermal-insulation wall, so as to form two cold boxes;

the first and the second assemblies are surrounded by a common thermal-insulation wall;

the three assemblies are surrounded by a common thermal-insulation wall so as to form a single cold box;

the plant also comprises a fourth assembly which comprises an argon-production column, and this fourth assembly is arranged beside the other assemblies, particularly close to the said second assembly so as to limit the head losses, between the said argon-production column and the low-pressure column, in the pipes which connect them;

the fourth assembly is surrounded by an individual thermal-insulation wall so as to form an individual cold box;

the argon-production column is made of at least two sections both surrounded by the said individual thermal-insulation wall;

the argon-production column is formed in at least two sections arranged one beside the other and each surrounded by an individual thermal-insulation wall so as to form as many individual cold boxes;

the plant further comprises a fifth assembly which comprises a column for mixing a gas and a liquid, and this fifth assembly is arranged beside the other assemblies, particularly close to the said third assembly, so as to limit the head losses between the mixing column and the heat-exchange line, in the pipes which connect them;

the fifth assembly is surrounded by an individual thermal-insulation wall so as to form an individual cold box;

each of the said assemblies has a height of about 30 m or less; and the plant comprises at least two assemblies connected by pipework at a pressure close to the low pressure, and these assemblies are arranged close to each other so as to limit the head losses in this or these pipes.

A final subject of the invention is a cold box comprising at least one structure for containing a cryogenic fluid and at least one thermal-insulation wall surrounding this structure, characterized in that the cold box is a cold box intended for the construction of a plant as defined hereinabove.

According to particular embodiments of the invention, the cold box may comprise one or both of the following features:

it has a height of about 30 m or less; and it is built at the workshop and is intended to be transported to an air-distillation plant construction site.

Figure 2A:
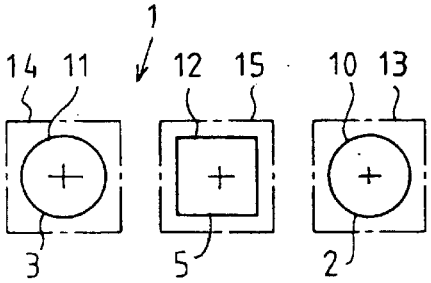
Figure 2B:
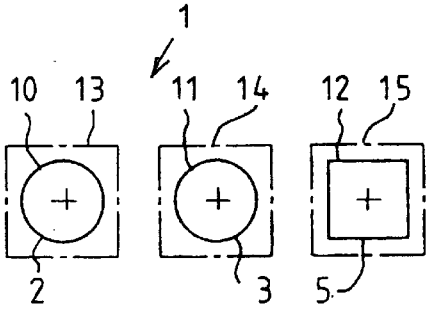
Figure 2C:
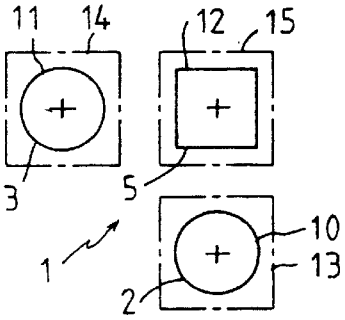
Figure 2D:
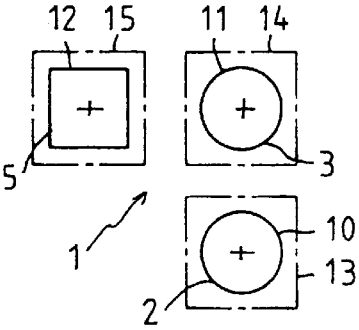
Figure 2E:
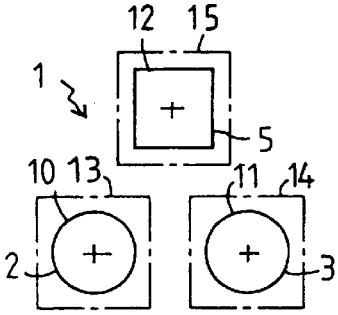
Figure 3:
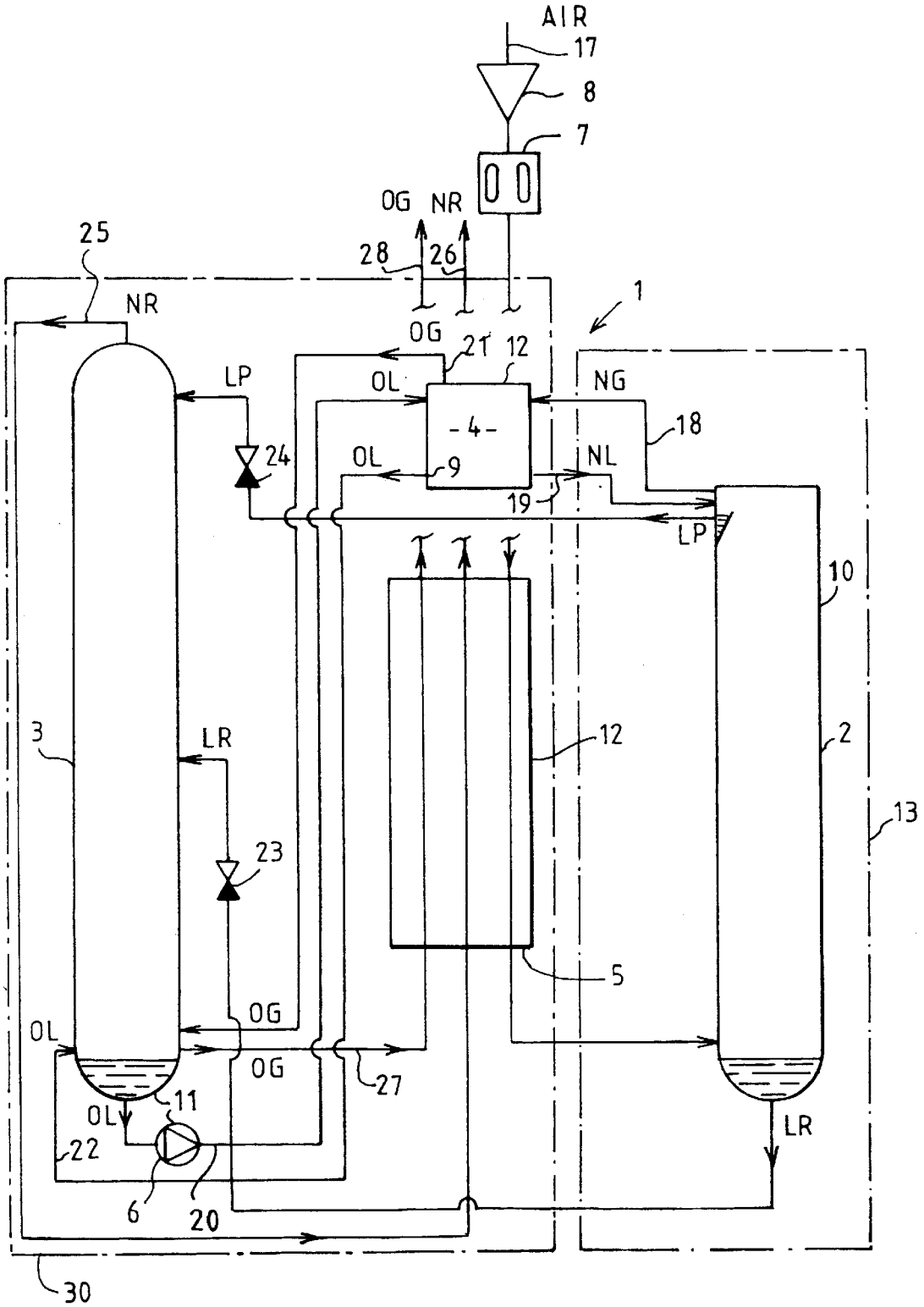
Figure 4A:
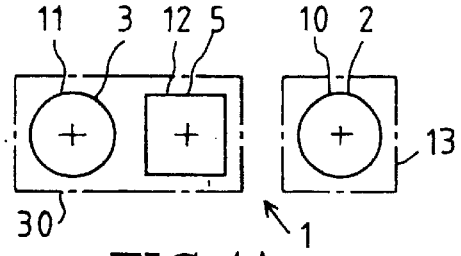
Figure 4B:
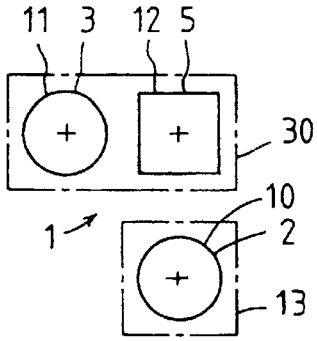
Figure 4C:
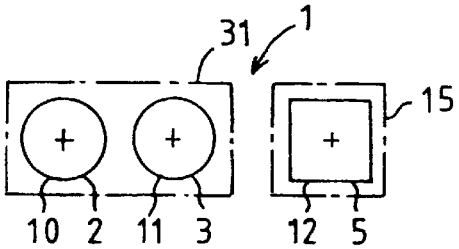
Figure 4D:
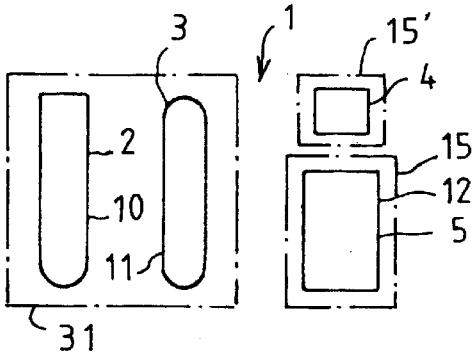
Figure 6A:
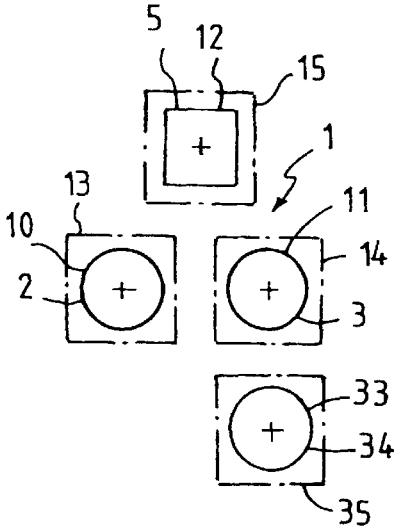
Figure 6B:
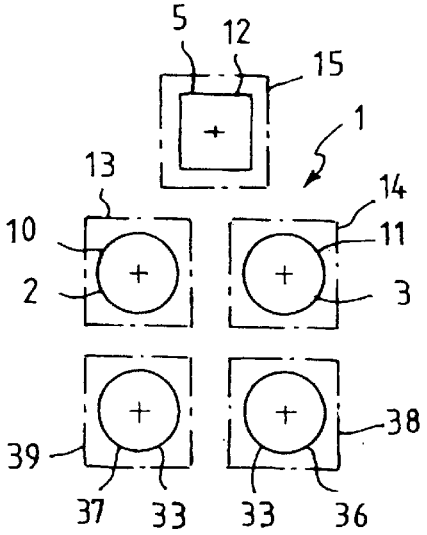
Figure 6C:
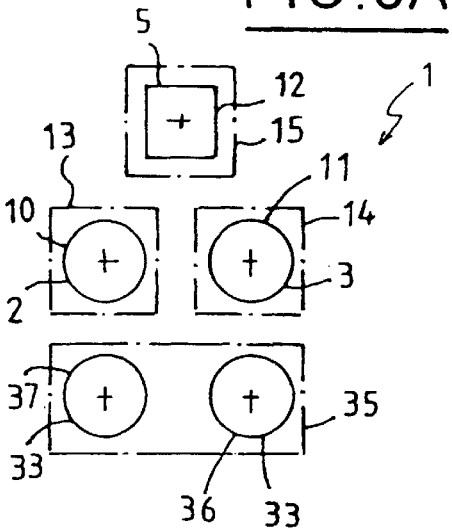
Figure 7:
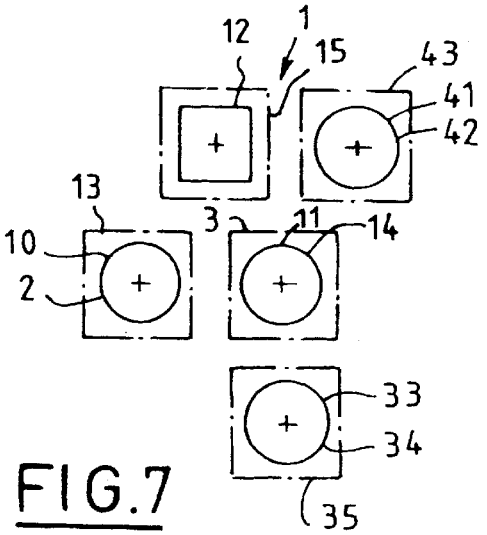
Figure 8:
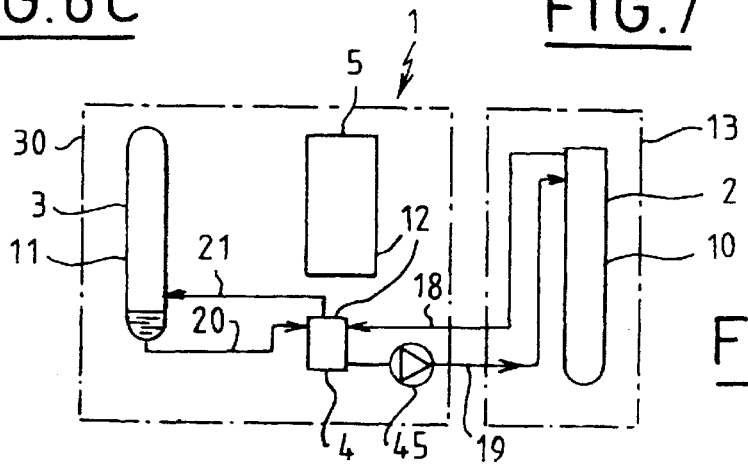
Figure 9:
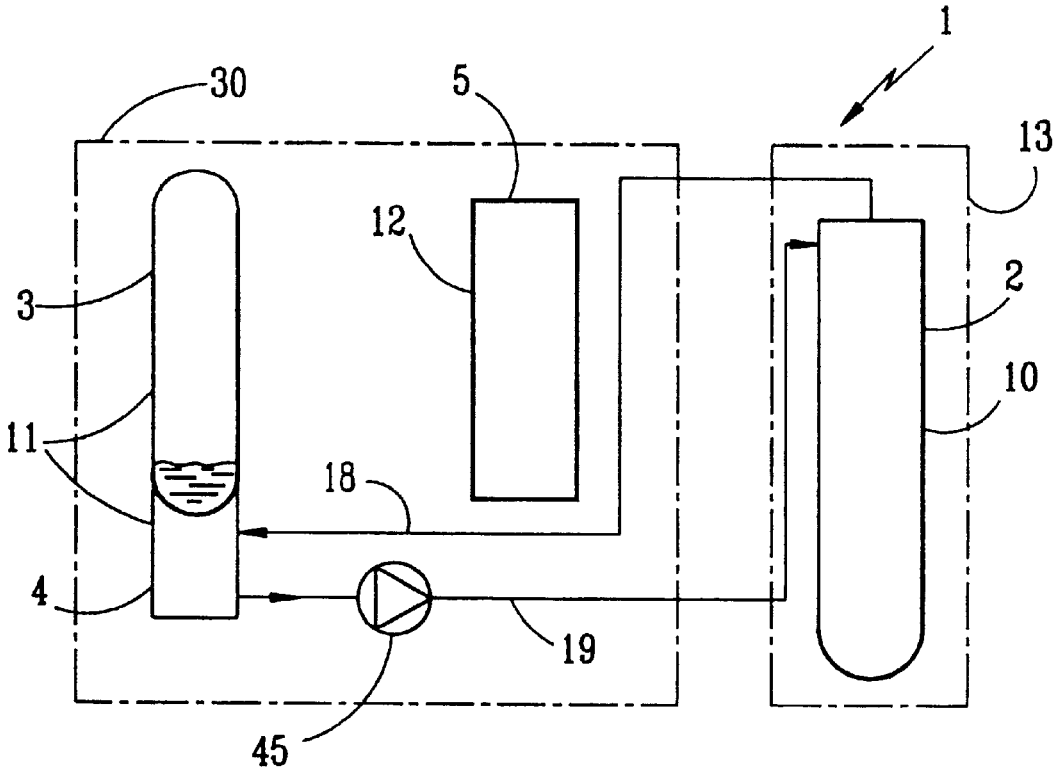

The invention will be better understood from reading the description which will follow, given merely by way of example and made with reference to the appended drawings, in which:

FIG. 1 is a diagrammatic view of a first embodiment of an air-distillation plant according to the invention, FIG. 2A is a diagrammatic view from above of the plant of FIG. 1, FIGS. 2B to 2E are views similar to FIG. 2A, illustrating alternative forms of the plant of FIG. 1, FIG. 3 is a view similar to FIG. 1, illustrating a second embodiment of an air-distillation plant according to the invention, FIG. 4A is a diagrammatic view from above of the plant of FIG. 3, FIGS. 4B and 4C are views similar to FIG. 4A, illustrating alternative forms of the plant of FIG. 3, FIG. 4D is a diagrammatic view in elevation of the plant of FIG. 4C, FIG. 5A to 5C are views similar to FIG. 2A, illustrating alternative forms of a third embodiment of an air-distillation plant according to the invention, FIGS. 6A to 6C and 7 are views similar to FIG. 2A, respectively illustrating three alternative forms of a fourth embodiment and a fifth embodiment of an air-distillation plant according to the invention, and FIGS. 8 and 9 are views similar to FIG. 4D, respectively illustrating a sixth and a seventh embodiment of an air-distillation plant according to the invention.

FIG. 1 depicts an air-distillation plant 1 essentially comprising a medium-pressure column 2, a low-pressure column 3, a vaporizer-condenser 4, a main heat-exchange line 5, a pump 6, an apparatus 7 for purifying air by adsorption and a main air compressor 8.

The columns 2 and 3 have structured packing, for example of the "cross-corrugated" kind, and are each made of a single section. An example of such packing is described in document U.S. Pat. No. 5,262,095.

The vaporizer-condenser 4, which places the fluids from the head of the column 2 and from the base of the column 3 in a heat-exchange relationship as described below, is of the liquid-oxygen trickling kind.

This vaporizer-condenser 4 conventionally comprises a heat exchanger formed of a collection of parallel plates between them delimiting passages of planar overall shape containing spacer-corrugations, the generatrices of which are vertical over most of the height of the passages.

Some of the passages of this exchanger are dedicated to the circulating of gaseous nitrogen from the head of the medium-pressure column 2. As it crosses them, this gaseous nitrogen condenses. The other passages are dedicated to the trickling of liquid oxygen from the base of the low-pressure column 3, to cause this liquid oxygen to vaporize by indirect exchange of heat with the gaseous nitrogen from the head of the medium-pressure column 2 which is condensing. The trickling of the liquid oxygen is such that a liquid-oxygen excess is obtained at a lower outlet 9 from the vaporizer-condenser 4.

The main heat-exchange line 5, depicted very diagrammatically, conventionally comprises a number of heat exchangers arranged in series and/or in parallel.

The plant 1 comprises three assemblies arranged one beside the other (FIG. 2A), mainly a first assembly 10 comprising the medium-pressure column 2 and the vaporizer-condenser 4 which lies on top of this column, a second assembly 11 comprising the low-pressure column 3 and the pump 6, and a third assembly 12 comprising the main heat-exchange line 5.

These three assemblies 10, 11 and 12 are each surrounded by an individual thermal-insulation wall 13, 14, 15, and thus form three separate cold boxes each delimited by one of the walls 13, 14, 15 and bearing the same numerical reference.

The third assembly 12 is arranged between the first two assemblies 10 and 11. The centres of the three assemblies 10, 11 and 12, identified by crosses in FIG. 2A, essentially form a line.

In operation, gaseous air brought in by a conduit 17 is compressed to a medium pressure by the compressor 8, then purified for water and for $CO_2$ by adsorption as it passes through the apparatus 7. This purified air is then chilled as it passes through the heat-exchange line 5 and then introduced, close to its dew point, at the base of the medium-pressure column 2.

A conduit 18 allows gaseous nitrogen to be conveyed from the head of the medium-pressure column 2 to an upper inlet of the vaporizer-condenser 4. A conduit 19 allows the condensed nitrogen to be returned from a lower outlet from the vaporizer-condenser 4 to the head of the medium-pressure column 2. The liquid oxygen that is to be vaporized is drawn off from the base of the low-pressure column 3 and is conveyed to an upper inlet of the vaporizer-condenser 4 by a conduit 20 equipped with the pump 6. Most of the pumped oxygen is vaporized then returned, by a conduit 21, to the base of the low-pressure column 3.

The liquid oxygen that is in excess after trickling is returned, by a conduit 22 connected to the outlet 9, to the base of the low-pressure column 3.

"Rich Liquid" RL (air enriched with oxygen) is sent from the base of the medium-pressure column 2, after its pressure has been reduced in a pressure-reducing valve 23, to an intermediate level of low-pressure column 3.

"Lean Liquid" LL (practically pure nitrogen) is sent from the head of the medium-pressure column 2 and after its pressure has been reduced in a pressure-reducing valve 24, to the head of the low-pressure column 3.

Impure or "residual" nitrogen RN, tapped off from the top of the low-pressure column 3 via a conduit 25, is heated in the heat-exchange line 5 by countercurrent indirect exchange of heat with the air that is to be 35 distilled passing through the line 5. This gas RN is removed via a conduit 26, possibly after having regenerated one of the two adsorbers of the apparatus 7.

Gaseous Oxygen GO, drawn off from the base of the low-pressure column 3 via a conduit 27, is heated as it passes through the heat-exchange line 5, by countercurrent indirect exchange of heat with the air that is to be distilled flowing along this line 5, then distributed by a production conduit 28.

The plant 1 is more economical and easier to construct than the plants of the prior art discussed at the beginning of the description.

This is because the three cold boxes 13, 14 and 15, which are less than 30 m tall, each have vertical and horizontal dimensions that are smaller than a cold box comprising the columns 2 and 3 and the vaporizer-condenser 4 one on top of the other, that is to say arranged as conventional double columns, together with the exchange line 5.

Thus, each of these cold boxes 13 to 15 can be prefabricated at the factory then transported onto the site where the number of operations to be performed to complete the construction of the plant 1 is limited.

What is more, their small dimensions on the one hand allow the size of the lifting gear used for installing them on site to be limited and, on the other hand, allow the measures to be set in place to ensure personnel safety during erection, and to ensure that the cold boxes installed on site will be able to withstand wind, earthquakes and radiation from the sun, to be reduced.

Finally, the chosen arrangement, with the second assembly 11 close to the third assembly 12, makes it possible to limit the head losses in the low-pressure conduits 25 and 27 connecting the column 3 to the line 5, and thus to limit the needs for compression and therefore to optimize the running costs of the plant 1.

As illustrated by FIGS. 2B to 2E, other relative arrangements of the assemblies 10, 11 and 12, displaying the same advantages as the arrangement of FIG. 2A, are possible, depending on the space available on the production site.

Thus, in FIG. 2B, the three assemblies 10, 11 and 12 are arranged in such a way that their centres essentially form a line, the assembly 11 being arranged between the assemblies 10 and 12.

In FIGS. 2C and 2D, the assemblies 10, 11 and 12 are arranged in such a way that their centres essentially form an L. The assembly 12 is arranged between the assemblies 10 and 11 in FIG. 2C, and the assembly 11 is arranged between the assemblies 10 and 12 in FIG. 2D.

In FIG. 2E, the assemblies 10, 11 and 12 are arranged in such a way that their centres essentially form an equilateral triangle.

FIG. 3 illustrates a second embodiment of an air-distillation plant 1 according to the invention, which can be differentiated from the one in FIG. 1 as follows.

The vaporizer-condenser 4 then belongs to the third assembly 12 and is arranged above the heat-exchange line 5. The lower part of the vaporizer-condenser 4 is arranged at more or less the same level as the upper end (at the top in FIG. 3) of the medium-pressure column 2.

What is more, a common thermal-insulation wall 30 surrounds the second and third assemblies 11 and 12, forming a first cold box delimited by the wall 30 and bearing the same numerical reference. Thus, the plant 1 comprises two cold boxes 13 and 30 and makes it possible to make savings as far as the thermal-insulation walls are concerned.

Good thermal insulation between the hot end of the heat-exchange line 5 and the lower part of the vaporizer-condenser 4 is afforded, for example, by the presence of air and/or perlite between these items.

As depicted in FIG. 4A, the assemblies 10, 11 and 12 are arranged with their centres essentially forming a line, in the same order as in FIG. 2A, the vaporizer-condenser 4 not being depicted in this figure, for reasons of greater clarity.

Just as was the case with the plant 1 of FIGS. 1 to 2E, other relative arrangements of the assemblies 10, 11 and 12 are possible, as illustrated, by way of example, by FIG. 4B, where the centres of the assemblies 10, 11 and 12 essentially form an L.

In another alternative form illustrated by FIGS. 4C and 4D, the first and second assemblies 10 and 11 are surrounded by a common thermal-insulation wall 31 to form a single cold box bearing the same numerical reference.

The vaporizer-condenser 4, not depicted in FIG. 4C for reasons of greater clarity, is arranged in a similar way to the preceding cases, on top of the heat-exchange line 5, but does not form part of the third assembly 12.

The third assembly 12, comprising the heat-exchange line 5, is surrounded by an individual thermal-insulation wall 15 to form an individual cold box bearing the same numerical reference. The vaporizer-condenser 4 is surrounded by an individual thermal-insulation wall 15' to form an individual cold box bearing the same numerical reference and which is secured to the cold box 15. The three assemblies 10, 11 and 12 are arranged in such a way that their centres form a line, the second assembly 11 being arranged close to the third assembly 12 and between the assemblies 10 and 12.

This alternative form makes it possible to produce separately a collection of cold boxes 15 and 15' comprising all the heat exchanges and a cold box 31 comprising the columns 2 and 3.

Figure 5A:
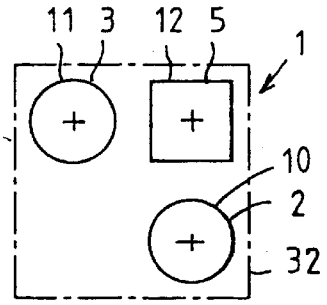
Figure 5B:
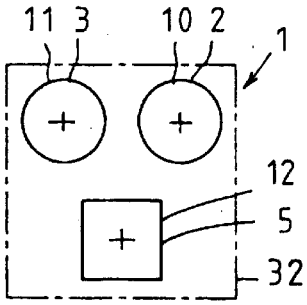
Figure 5C:
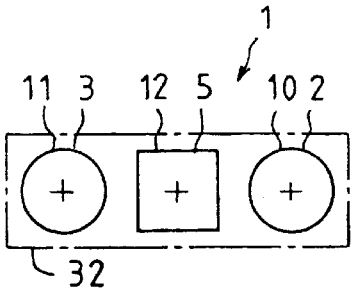

FIGS. 5A to 5C illustrate a third embodiment of an air-distillation plant 1 according to the invention, which can be differentiated from the one in FIG. 1 as follows. The assemblies 10, 11 and 12 are surrounded by a common thermal-insulation wall 32 so as to form a single cold box delimited by the wall 32 and bearing the same numerical reference. Just as in the case of the plant 1 of FIGS. 1 to 2E, the relative arrangements of the assemblies 10, 11 and 12 can vary. Thus, as depicted by way of example in FIGS. 5A to 5C, these assemblies 10, 11 and 12 may be arranged in such a way that their centres essentially form an L, an equilateral triangle or a line.

Of course, the plant may comprise other items of equipment which may or may not be incorporated into the cold box or boxes formed, such as, for example, distillation columns made in one or more sections and participating, for example, in the production of argon, storage reservoirs or a column for mixing a gas and a liquid, an external vaporizer-condenser, a so-called "Etienne" column described, for example, in document U.S. Pat. No. 2,699,046, a column for the production of virtually pure argon by distillation, etc.

Thus, FIG. 6A diagrammatically illustrates an air-distillation plant 1 similar to the one in FIG. 2E and further comprising a fourth assembly 33 essentially comprising a column 34 for the production of impure argon.

The fourth assembly 33 is surrounded by an individual thermal-insulation wall 35 to form an individual cold box bearing the same reference and less than 30 m tall.

The fourth assembly 33 is arranged close to the second assembly 11 so as to limit the head losses between the conduits (not depicted) which in the conventional way connect the column 34 to the low-pressure column 3.

FIG. 6B illustrates an alternative form of the plant 1 of FIG. 6A, which can be differentiated from the latter in that the column 34 is made in two sections arranged one beside the other, namely a first section 36 supplied with a ternary mixture (Ar, $N_2$ and $O_2$) originating from the low-pressure column 3, and a second section 37, the base of which is connected to the head of the first section 36. Such a two-section embodiment is described in document EP-A-628,277.

The sections 36 and 37 are each surrounded by an individual thermal-insulation wall 38, 39 to form two individual cold boxes bearing the same numerical references and less than 30 m tall.

The cold boxes 13, 14, 38 and 39 are arranged in such a way that their centres essentially form a square, with the cold box 38 arranged close to the cold box 14. Thus, head losses in the conduits connecting the low-pressure column 3 to the first section 36 of the column 34 are limited.

FIG. 6C illustrates another alternative form of the plant 1 of FIG. 6A, which can be differentiated from the one of FIG. 6B in that the two sections 36 and 37 of the argon-production column 34 are surrounded by a common thermal-insulation wall 35, to form a cold box bearing the same numerical reference and less than 30 m tall.

FIG. 7 illustrates a fifth embodiment of an air-distillation plant 1 according to the invention, which can be differentiated from the one in FIG. 6A in that it comprises a fifth assembly 41 which comprises a column 42 for mixing a liquid and a gas.

A mixing column is a cryogenic structure for the containment of fluid for mixing a gas and a liquid, for example, as described in document FR-B-2,143,986 in the name of the present assignee, gaseous air and liquid oxygen at the medium pressure.

The centres of the assemblies 10, 11, 41 and 12 essentially form a diamond.

The fifth assembly 41 is arranged beside all the assemblies 10, 11, 12 and 33 and close to the third assembly 12.

The head losses in the conduits which, in the conventional way, functionally connect the heat-exchange line 5 and the mixing column 41 for producing impure oxygen, are thus limited.

Of course, other relative arrangements of the assemblies in these fourth and fifth embodiments, which also limit the head losses, particularly in the low-pressure conduits, are possible, for example based on the configurations illustrated in FIGS. 2A to 2E, 4A to 4C and 5A to 5C.

FIG. 8 diagrammatically illustrates a sixth embodiment of an air-distillation plant 1, but can be differentiated from the one in FIG. 3 as follows.

The vaporizer-condenser 4 is a bath-type vaporizer-condenser arranged under the heat-exchange line 5, at essentially the same level as the base of the low-pressure column 3.

The transfer of liquid oxygen from the base of the low-pressure column 3 to the vaporizer-condenser 4 takes place hydrostatically, without the need for a pump in the conduit 20.

By contrast, there is a pump 45 in the conduit 19, for raising the liquid nitrogen from the lower part of the vaporizer-condenser 4 towards the head of the medium-pressure column 2.

FIG. 9 diagrammatically illustrates a seventh embodiment of an air-distillation plant 1 which can be differentiated from the one in FIG. 8 as follows.

The vaporizer-condenser 4 belongs to the second assembly 11 and the low-pressure column 2 lies on top of the vaporizer-condenser 4.

In all the embodiments described above, the medium pressures are higher than the low pressures.

Thus, the operating pressures of the medium pressure 2 and low-pressure 3 columns may typically be between about 5 and 7 bar and between about 1 and 2 bar, respectively. However, they could just as well be outside of these ranges and be equal to about 15 and about 5 bar, respectively.

Key to captions for FIGS. 1 and 3

| FRENCH CAPTION | ENGLISH EQUIVALENT |
|---|---|
| AIR | AIR |
| LP | LL |
| LR | RL |
| NG | GN |
| NL | LN |
| NR | RN |
| OG | GO |
| OL | LO |

What is claimed is:

1. In an air distillation plant comprising a first assembly comprising a medium-pressure column, a second assembly comprising low-pressure column, a third assembly comprising a heat-exchange line for cooling air to be distilled, and a vaporizer-condenser, the top of the medium-pressure column and the bottom of the low-pressure column being in fluid communication with the vaporizer-condenser, the medium-pressure column and the low-pressure column being in fluid communication with the heat-exchange line; the improvement wherein said three assemblies are disposed one beside the other and said three assemblies, when viewed from above, form a triangle.

2. A plant according to claim 1, wherein at least one of said columns is equipped with structured interior packing.

3. A plant according to claim 1, wherein said vaporizer-condenser belongs to said first assembly and lies on top of the medium-pressure column.

4. A plant according to claim 1, wherein the vaporizer-condenser lies on top of the heat-exchange line and comprises a portion of the third assembly.

5. Plant according to claim 1, wherein the vaporizer-condenser belongs to said second assembly and said low-pressure column lies on top of the vaporizer-condenser.

6. Plant according to claim 1, wherein the vaporizer-condenser is disposed beneath the heat-exchange line and forms a portion of the third assembly.

7. Plant according to claim 1, wherein the vaporizer-condenser is of the liquid-oxygen trickling type.

8. Plant according to claim 1, wherein each of said assemblies has a height no more than 30 meters.

9. In an air distillation plant comprising a first assembly comprising a medium-pressure column, a second assembly comprising low-pressure column, a third assembly comprising a heat-exchange line for cooling air to be distilled, and a vaporizer-condenser, the top of the medium-pressure column and the bottom of the low-pressure column being in fluid communication with the vaporizer-condenser, the medium-pressure column and the low-pressure column being in fluid communication with the heat-exchange line; the improvement wherein each of said assemblies is surrounded by an individual thermal insulation wall so that each forms an individual cold box.

10. A plant according to claim 9, wherein at least one of said columns is equipped with structured interior packing.

11. A plant according to claim 9, wherein said vaporizer-condenser belongs to said first assembly and lies on top of the medium-pressure column.

12. A plant according to claim 9, wherein the vaporizer-condenser lies on top of the heat-exchange line and comprises a portion of the third assembly.

13. Plant according to claim 9, wherein the vaporizer-condenser belongs to said second assembly and said low-pressure column lies on top of the vaporizer-condenser.

14. Plant according to claim 9, wherein the vaporizer-condenser is disposed beneath the heat-exchange line and forms a portion of the third assembly.

15. Plant according to claim 9, wherein the vaporizer-condenser is of the liquid-oxygen trickling type.

16. Plant according to claim 9, wherein each of said assemblies has a height no more than 30 meters.

17. In an air distillation plant comprising a first assembly comprising a medium-pressure column, a second assembly comprising low-pressure column, a third assembly comprising a heat-exchange line for cooling air to be distilled, and a vaporizer-condenser, the top of the medium-pressure column and the bottom of the low-pressure column being in fluid communication with the vaporizer-condenser, the medium-pressure column and the low-pressure column being in fluid communication with the heat-exchange line; the improvement wherein said third assembly and one of said first and second assemblies is surrounded by a common thermal insulation wall and the other of said first and second assemblies is surrounded by an individual thermal insulation wall so as to form two cold boxes.

18. A plant according to claim 17, wherein at least one of said columns is equipped with structured interior packing.

19. A plant according to claim 17, wherein said vaporizer-condenser belongs to said first assembly and lies on top of the medium-pressure column.

20. A plant according to claim 17, wherein the vaporizer-condenser lies on top of the heat-exchange line and comprises a portion of the third assembly.

21. Plant according to claim 17, wherein the vaporizer-condenser belongs to said second assembly and said low-pressure column lies on top of the vaporizer-condenser.

22. Plant according to claim 17, wherein the vaporizer-condenser is disposed beneath the heat-exchange line and forms a portion of the third assembly.

23. Plant according to claim 17, wherein the vaporizer-condenser is of the liquid-oxygen trickling type.

24. Plant according to claim 17, wherein each of said assemblies has a height no more than 30 meters.

* * * * *